United States Patent [19]

DeGennaro et al.

[11] 4,078,264

[45] Mar. 14, 1978

[54] ARTICLE OF CLOTHING

[76] Inventors: Frank A. DeGennaro; Catherine Mary DeGennaro, both of 115 Cross St., Little Silver, N.J. 07739

[21] Appl. No.: 744,165

[22] Filed: Nov. 22, 1976

[51] Int. Cl.[2] ..... A41D 3/08

[52] U.S. Cl. ..... 2/88; 150/1

[58] Field of Search ..... 2/85, 84, 87, 88, DIG. 6; 150/1

[56] References Cited

U.S. PATENT DOCUMENTS

| | | | |
|---|---|---|---|
| 2,024,044 | 12/1935 | Johnson | 2/88 |
| 2,058,474 | 10/1936 | Long | 2/85 |
| 2,462,269 | 2/1949 | Krempel | 2/84 |
| 2,717,437 | 9/1955 | DeMestral | 2/DIG. 6 |
| 3,522,612 | 8/1970 | Palmer | 2/84 |

*Primary Examiner*—Doris L. Troutman

[57] ABSTRACT

An article of clothing, such as a thermally lined cape, includes an integral storage compartment into which the cap can be folded to form a cushion. When not used to store the cape, the compartment can be used to store a pair of gloves, foul weather pants, et cetera. The storage compartment also includes a handle to facilitate carrying the cape when folded into the storage compartment.

9 Claims, 12 Drawing Figures

ARTICLE OF CLOTHING

BACKGROUND OF THE INVENTION (a) Field of the Invention

Broadly speaking, this invention relates to an article of clothing. More particularly, in a preferred embodiment, this invention relates to an article of clothing having an integral storage compartment, which compartment can also serve as a cushion, a personal flotation device, or the like, while the article of clothing is not being worn.

(b) Discussion of the Prior Art

People who engage in outdoor sporting activities such as hunting, fishing, boating, camping, hiking, and skiing often have to contend with inclement weather and, to that end, must generally carry with them suitable waterproof, lined clothing. At a minimum this clothing consists of a jacket or cape, but waterproof trousers, warm gloves, et cetera, are also often a necessity. The problem is not, of course, limited to people who engate in these activities but also affects the spectators of the events.

Consider, for example, the spectators of winter sports, such as football, who frequently find it necessary to provide themselves with a warm coat or blanket to keep comfortable while observing the game. If it turns out not to be as cold as was forecast, the coat or blanket may be folded and used as a cushion or pillow to provide some measure of protection from the hard seats or bleachers commonly used at such sporting events.

Unfortunately, a conventional coat does not make a very comfortable cushion; likewise, a blanket is awkward and difficult to carry around when travelling to and from the football field.

SUMMARY OF THE INVENTION

As a solution to this and other problems, I have invented a novel garment, illustratively a lined cape, which has an integral storage compartment into which the cape can be folded when not in use. The storage compartment is provided with a carrying handle, thus providing an extremely convenient manner for transporting the cape. Alternatively, the cape, when stored in its compartment, can serve as a comfortable cushion or pillow for the user to use while watching the game.

Of course, the storage compartment has other uses. While the article of clothing is being worn, it may be used to store a pair of gloves, a pair of slip-on rain shoes, et cetera. Or, in the event the garment comprises a boater's or fisherman's foul weather suit, the compartment may be used to store a matching pair of foul weather trousers.

The invention and its mode of construction will be more fully understood from the following detailed description, when taken with the following drawings in which:

DETAILED DESCRIPTION OF THE INVENTION

Figure 1:
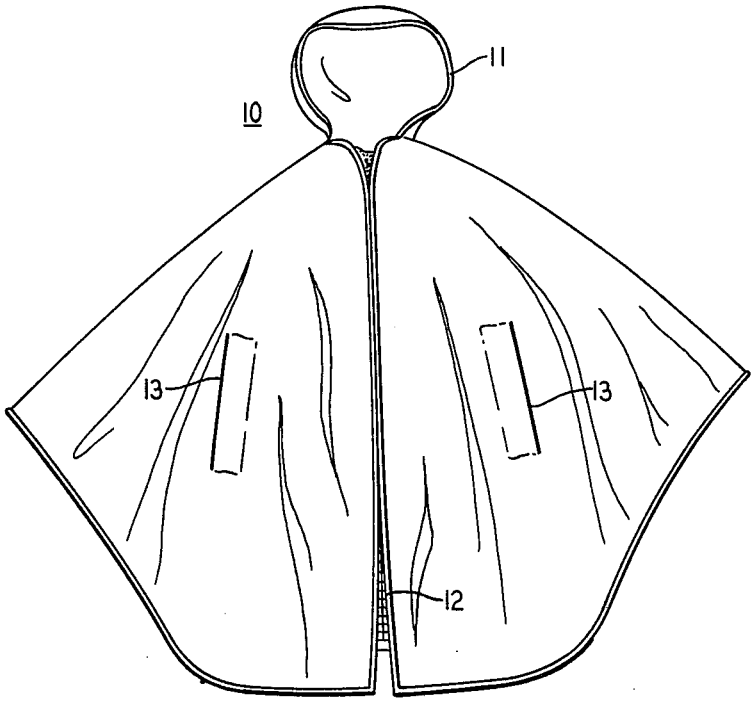
FIG. 1 is a front view of the cape, fully extended.

FIG. 1 is a front view of the cape 10 as worn by a user. It should be emphasized that the garment shown is merely illustrative and the invention is not limited to a cape but encompasses coats, jackets, parkas, waterproof foul weather gear, et cetera. Neither are the materials from which the cape is manufactured intended to be limiting and may include natural fibers such as cotton, wool, oilskin, flax, et cetera, or artificial fibers such as acetates, nylon, dacron, et cetera, or any combination thereof.

Figure 2:
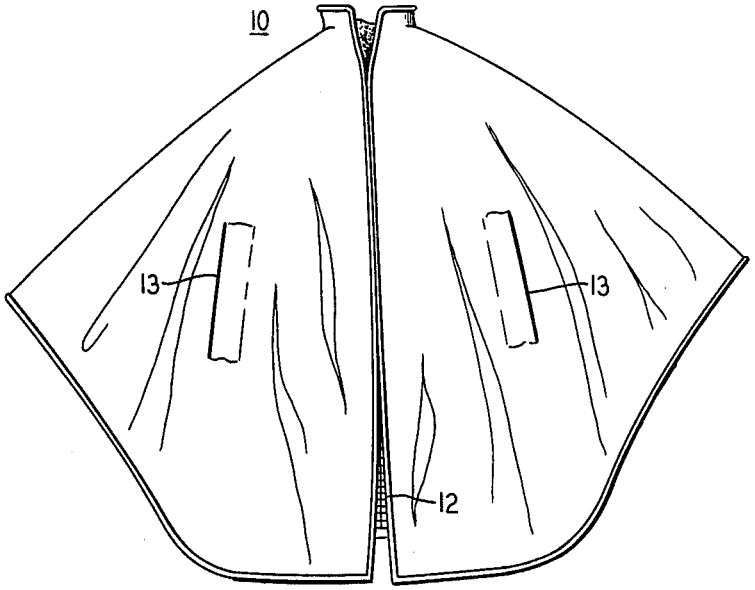
FIG. 2 is another front view of the cape showing the attached hood folded out of sight.

As shown in FIG. 1, cape 10 includes an attached hood 11 and a self-contained storage compartment therefor (not shown), so that the hood may be tucked away out of sight when not needed, as shown in FIG. 2. The cape further includes such conventional items as a zipper 12, and pockets 13—13.

Figure 3:
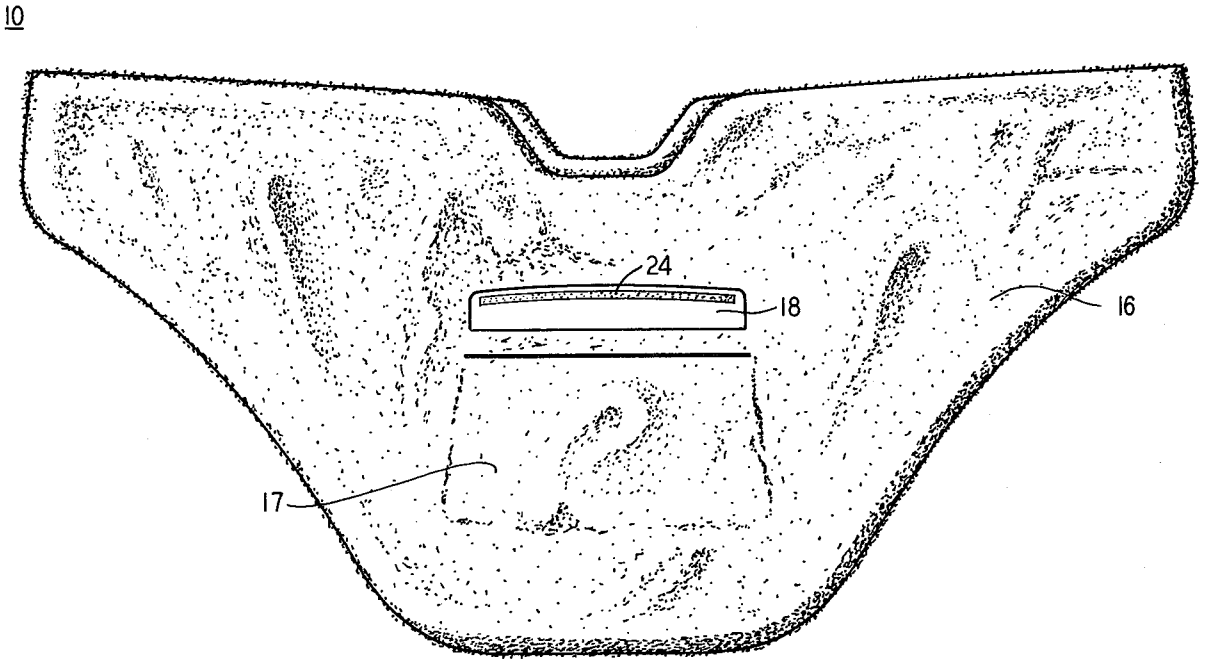
FIG. 3 is a rear view of the cape showing the normally hidden storage compartment.
Figure 4:
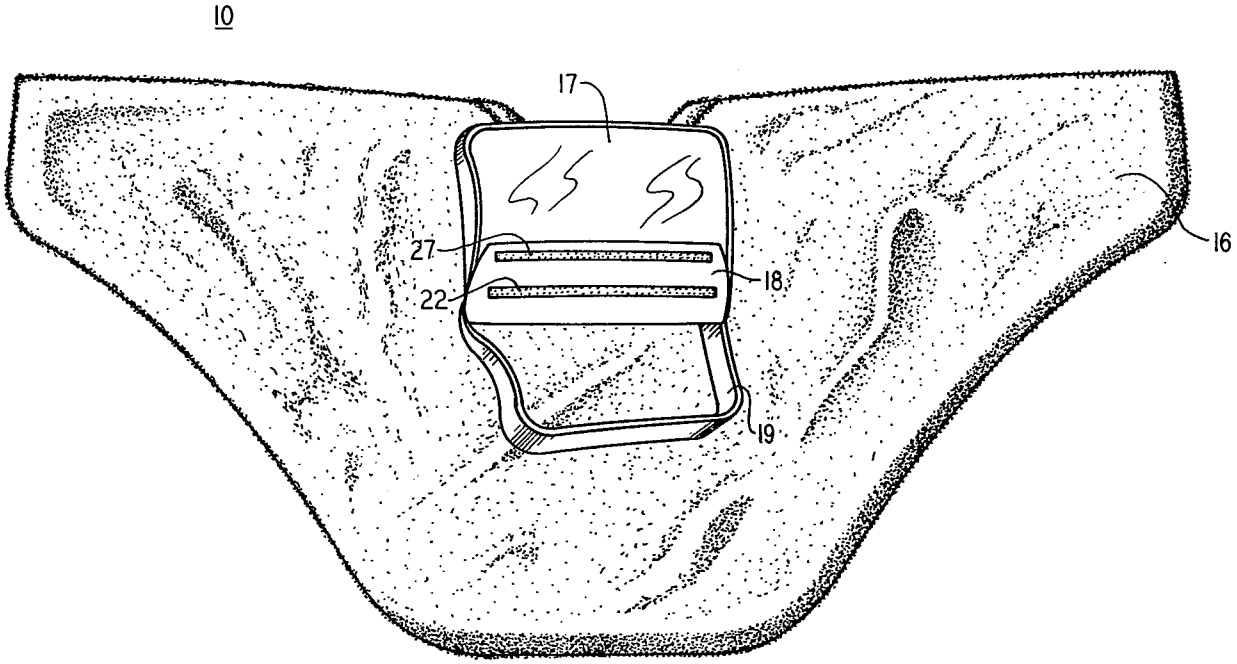
FIG. 4 is another rear view of the cape showing the storage compartment after it has been pulled out preparatory to storing the cape.
Figure 5:
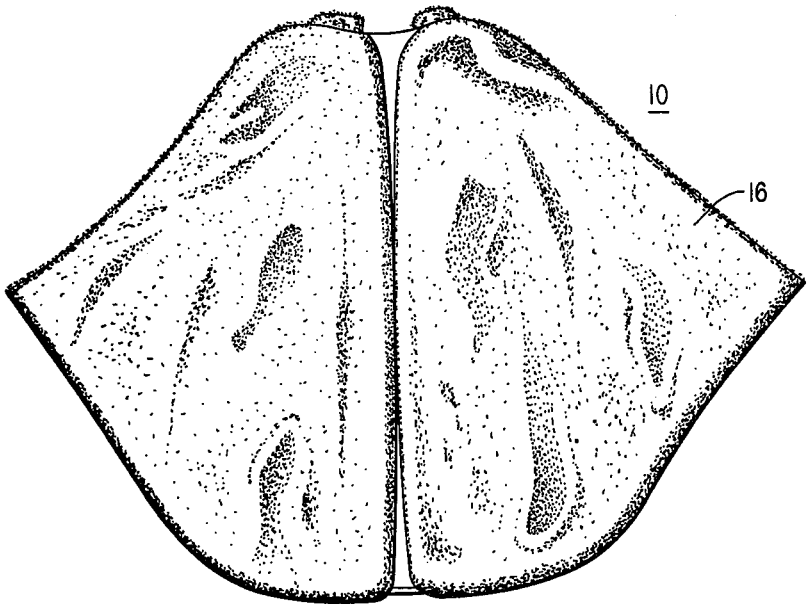
FIGS. 5–8 are a sequence of drawings illustrating how the cape is folded for insertion into the storage compartment.
Figure 6:
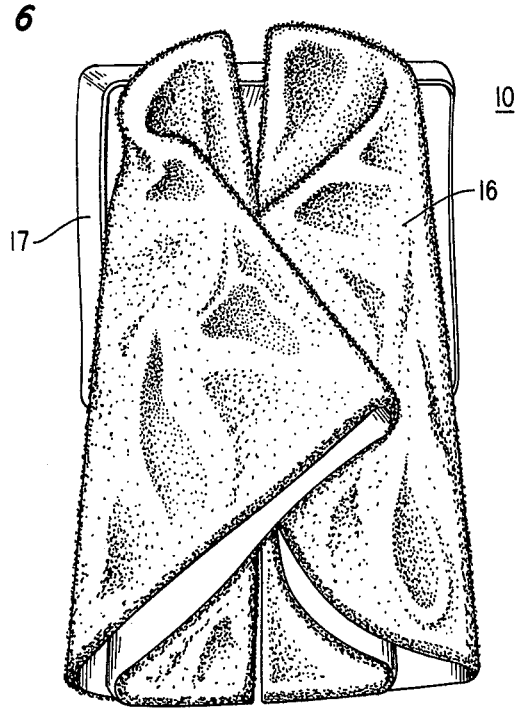
Figure 7:
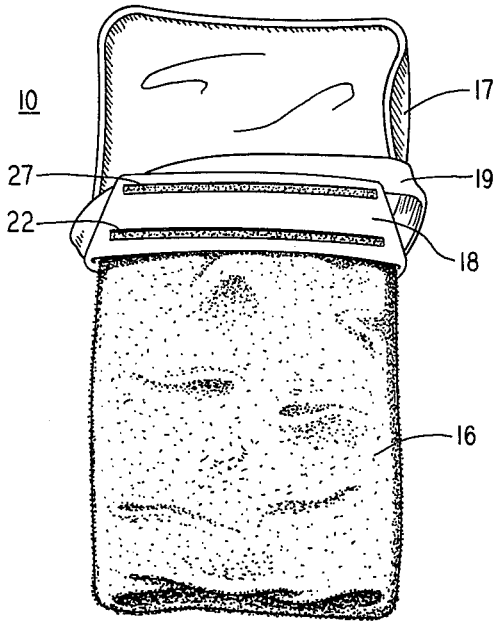
Figure 8:
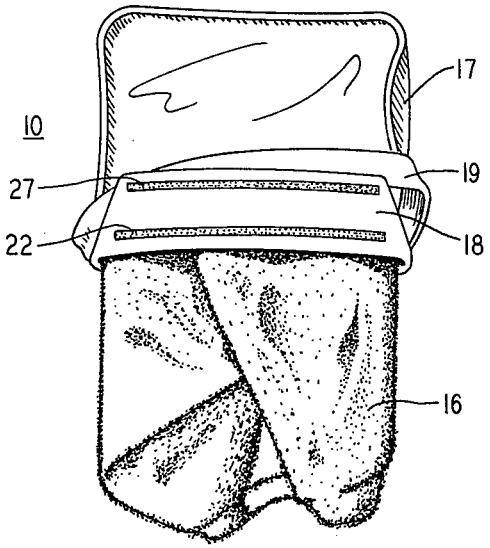
Figure 9:
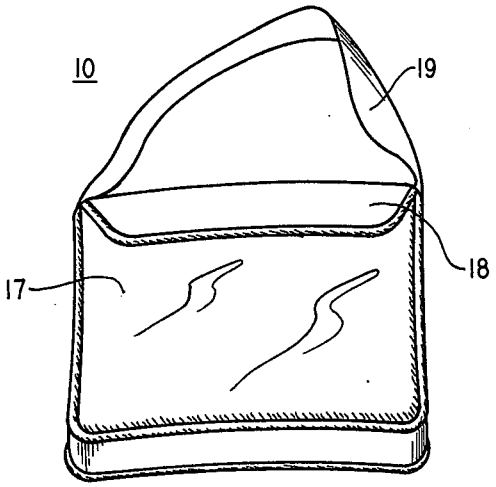
FIGS. 9 and 10 are front views of the storage compartment in its pocket book and cushion formats, respectively.
Figure 10:
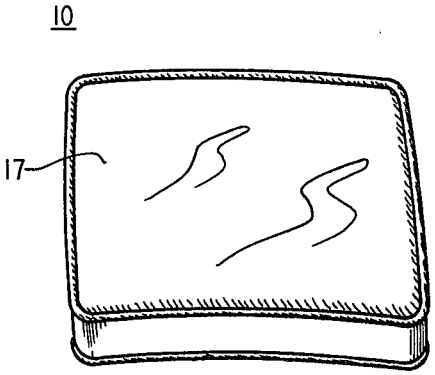

As best seen from FIGS. 3 and 4, cape 10 has on its rear or inner face, some suitable thermal lining 16, for example, wool or the like, and a hidden storage compartment 17 having a reinforced opening 18 at the upper end thereof. As seen in FIG. 4, the storage compartment 17 actually comprises a sack or bag, similar to a large pocket book, having a flap 18 with a strip of loop-pile fastening fastened thereto. The compartment 17 is, of course, permanently affixed to the inner surface of cape 10 and, thus cannot be separated therefrom. However, as shown in the sequence of drawings, FIGS. 5–8, the cape can be carefully folded up into the container, flap 18 closed and sealed to the mating loop-pile fastening strip on the other side thereof to form the tote bag shown in FIG. 9, complete with handles 19, or by folding the handles in the cushion shown in FIG. 9, which as previously mentioned, is useful in spectator sports, boating, et cetera, wherever hard, uncomfortable seats are encountered.

Figure 11:
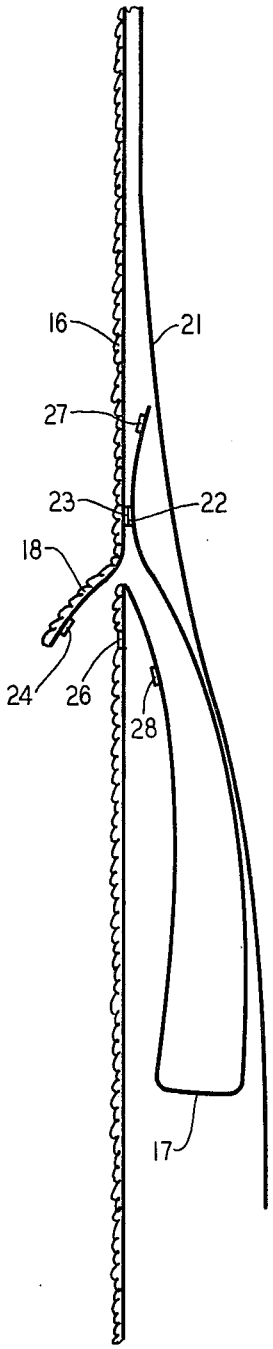
FIGS. 11 and 12 are cross-sectional views of the cape showing the storage compartment in more detail.

FIG. 11 depicts the construction of storage compartment 17 in greater detail. As shown, element 21 is the outer wall of the cape and 16 represents the lined, inner surface normally worn closest to the user's body.

Storage compartment 17 normally lies between inner and outer walls 16 and 21 of the cape while the cape is being worn. It is in this configuration that the compartment may be used to store gloves, foul weather trousers, et cetera. The upper end of compartment 17 is secured by a strip of pressure-sensitive adhesive material 22, such as loop pile fastening, to a mating strip 23 which is part of the inner wall of inner surface 16. Thus, when a similar strip of adhesive material 24 on flap 18 is sealed to a corresponding strip 26 on the inner wall of inner surface 16, the compartment 17 is completely sealed and any item stored therein will be secure from accidental loss. As shown, the upper end of the compartment carries two additional self-sealing Velcra strips 27 and 28, respectively, whose use will become apparent in the discussion below.

Figure 12:
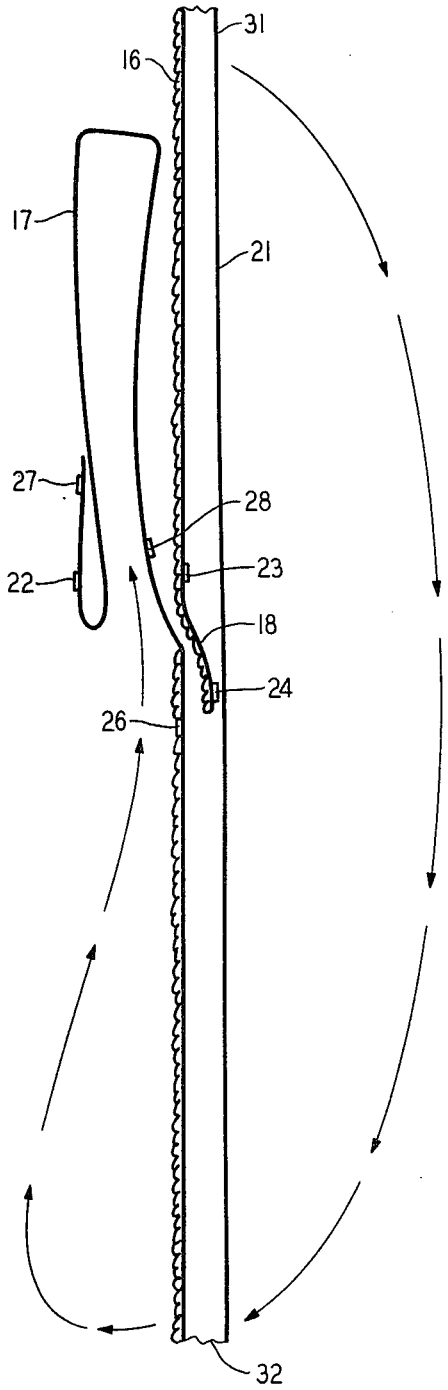

FIG. 12 depicts the situation wherein compartment 17 has been pulled out, If the upper end of the cape 31 is folded down to the right so that it lies alongside the lower end 32, then both ends are folded up to the left and inserted into compartment 17, the previously mentioned pillow or cushion will be formed. Compartment 17 is then sealed by pressing loop-pile fastening strip 27 into engagement with loop-pile fastening strip 28.

Among the advantages of this invention is the fact that, because of the unitary structure, it is impossible to lose the cape from the container or vice-versa. Also, the cushion that results when the cape is carefully folded into the container is evenly stuffed and far superior to sitting on a conventional coat that has been hastily and carelessly folded.

One skilled in the art can make various changes and substitutions to the arrangement of parts shown without departing from the spirit and scope of the invention.

What we claim is:

1. In combination with an article of clothing having inner and outer surfaces, a storage compartment integral with said inner surface and normally lying between said inner and outer surfaces, said storage compartment being fastened along one edge to said inner surface and having an opening therein into which said article of clothing may be stuffed for storage, said storage compartment being adapted to fold into itself through said opening when said article of clothing is being worn.

2. The article of clothing according to claim 1 wherein said article has a cape-like configuration and said storage compartment is provided with a handle to facilitate portage of said article when folded into said storage compartment.

3. The article according to claim 2 wherein said handle is adapted to be folded into said storage compartment whereby said storage compartment functions as a cushion.

4. The article according to claim 3 wherein said cape-like member includes at least one pocket and an integral hood.

5. The article according to claim 4 wherein said article is comprised of a waterproof material and is lined with a thermal material.

6. The article according to claim 1 wherein said storage compartment includes pressure-sensitive means for securing the upper end of said compartment to the inner wall of said inner surface.

7. The article according to claim 6 wherein said inner surface includes a flap and pressure-sensitive means for securing said flap to said inner surface to prevent articles stored in said storage compartment from falling therefrom.

8. The article according to claim 7 including pressure-sensitive means for securing that portion of said storage compartment, previously secured to said inner surface, to said storage compartment to seal the same when said article of clothing is stored therein to form a pillow or cushion.

9. The article of clothing according to claim 1 wherein said integral storage compartment is situated approximately medially along the principal axis of the article so that when the garment is worn by the user the storage compartment aligns with the small of the user's back whereby the presence of the storage compartment cannot be detected by visual observation.

* * * * *